US005351703A

United States Patent [19]

Moe et al.

[11] Patent Number: 5,351,703

[45] Date of Patent: Oct. 4, 1994

[54] WALKING CANE/QUICK ATTACHMENT CUE STICK

[76] Inventors: Michael C. Moe; Leo Rosenvold, both of R.R. 4, P.O. Box 2, Williston, N. Dak. 58801

[21] Appl. No.: 982,711

[22] Filed: Nov. 27, 1992

[51] Int. Cl.[5] ..... A45B 9/02

[52] U.S. Cl. ..... 135/77; 135/76; 135/66; 473/46

[58] Field of Search ..... 135/65, 66, 69, 72, 135/77, 73, 75, 76; 403/109, 104, 343, 361, 364, 222, 293, 311; 273/68, 69, 70

[56] References Cited

U.S. PATENT DOCUMENTS

| | | | |
|---|---|---|---|
| 529,731 | 11/1894 | Gschwentner . | |
| 1,092,189 | 4/1914 | Varian . | |
| 3,334,901 | 8/1967 | Steffes | 273/68 |
| 3,342,489 | 9/1967 | Waldo | 273/68 |
| 3,534,959 | 10/1970 | Elswick | 273/68 |
| 4,147,346 | 4/1979 | Giannetti | 273/23 |
| 4,314,575 | 2/1982 | Kuo | 273/68 |
| 4,730,632 | 3/1988 | Mace | 135/76 |
| 4,896,687 | 1/1990 | Segal et al. | 135/75 |

FOREIGN PATENT DOCUMENTS

| | | | |
|---|---|---|---|
| 0815412 | 6/1969 | Canada | 273/68 |
| 0376044 | 5/1923 | Fed. Rep. of Germany | 135/66 |

*Primary Examiner*—Carl D. Friedman
*Assistant Examiner*—Winnie Yip
*Attorney, Agent, or Firm*—David A. Lingbeck

[57] ABSTRACT

This invention relates to a combination walking cane/-quick attachment cue stick comprising a non-threading fastener means to assemble a rearward end of a forward shaft to an open end of a rearward shaft to form the cue stick and to fasten the rearward shaft and a cap member over the forward shaft to conveniently form the walking cane. The fastener means comprises a plurality of resilient rings which securely engages the interior of either the cap member or the rearward shaft to securely hold either the cap member or the rearward shaft to and about the forward shaft. The cue stick further comprises a slide member which is slidably mounted on the forward shaft and extendable forward of the cue tip to further steady and assist the aim of the user using this cue stick. Further, replaceable weighted plugs are engageably mounted in the rearward end of the forward shaft to provide the user with a cue stick having a desired weight and balance.

4 Claims, 5 Drawing Sheets

WALKING CANE/QUICK ATTACHMENT CUE STICK

BACKGROUND OF THE INVENTION

The present invention relates to a combination walking cane and quick attachment cue shirk with slide.

Walking canes and billiard cues and combinations thereof are known in the prior art. Inventors have for decades functionally designed different billiard cues and accessories thereof to accomplish different objectives. One known prior art is an EASY GLIDE CUE GLIDE, U.S. Pat. No. 4,147,346, comprising a hand held guide which includes a laterally extending support member adapted to effectively rest on a billiard table to steady the cue stick upon striking the cue ball and includes longitudinal rows of ball bearings circumferentially spaced about the interior of the hand held glide to augment sliding of the cue stick through the hand held guide. The hand held guide does not move along the cue stick but essentially remains stationary as the cue stick slidably moves through the hand held guide.

Another known prior art is a BILLIARD CUE, U.S. Pat. No. 1,092,189, comprising a cue; a sleeve about a portion of the cue, having a longitudinal slot through said slot; and a pin laterally disposed in the cue and slidably positioned in the longitudinal slot for forward and backward movement therein to guide the movement of the sleeve. The sleeve essentially impacts the cue ball as the cue is held stationary, not the cue.

Another known prior is a BILLIARD CUE, U.S. Pat. No. 529,731, comprising a two part cue stick with the parts rigidly secured to one another at their ends, a slidable sleeve mounted on the forward part and held by the fingers of the user as the cue stick slides through the sleeve. The tip of the cue stick effectively stops the forward slide of the sleeve as the rearward part of the cue stick effectively prevents the rearward slide of the sleeve. The sleeve does not slide forward the tip of the cue stick and is not used to aim the cue ball.

Another known prior art is a BILLIARD CUE WITH GUIDE MEMBER, U.S. Pat. No. 3,534,959, comprising a conical sleeve slidably mounted about a cue stick for movement along a portion of the cue stick and a flanged inner sleeve fixedly attached to the interior of the conical sleeve to substantially provide stops at which the shaft of the cue stick is allowed to slide within the conical sleeve. The cue stick is not detachable into separate parts for convenient transportation thereof, and the conical sleeve does not slide forward of the cue tip.

Another known prior art is WEIGHTED HANDLE FOR A BILLIARD CUE, U.S. Pat. No. 3,342,489, comprising a two piece billiard stick with the forward piece threaded into the rearward piece, a pair of O-rings spaced apart along the length of the cue stick at the end thereof for keeping weighted sleeves on said shaft between the pair of O-rings. The weighted sleeves are slidably mounted over the end O-ring which is compressed to receive the weighted sleeve and functions as a stop to prevent the weighted sleeves from sliding off the end of the billiard during use thereof. The O-rings functions as stops for weighted sleeves slidably mounted between the O-rings.

There is a need for a new, easy attachable and detachable cue stick for convenient transportation thereof which also has a slide to guide and support the cue stick and to effectively aim the cue stick upon striking the cue ball, which overcomes the problems of the prior arts noted above.

SUMMARY OF THE INVENTION

The present invention relates to a combination walking cane and quick attachment cue stick with a slide comprising a generally hollow elongated forward shaft with a leather tip or other suitable material fixedly attached to an end thereof for striking the cue ball, a generally hollow elongated rearward shaft slidably engageable on the end of the forward shaft opposite the cue tip and further functioning as a protective sleeve into which the forward shaft slides and as a walking cane, and an elongated cap slidably engaged about the other end of the forward shaft to transform the cue stick into a walking cane.

It is an object of the present invention to provide a combination walking cane and quick attachment cue stick with a slide which effectively, conveniently, and quickly transforms from a walking cane to a cue stick and vice versa without having to screw and unscrew the two shafts together as in other multiple piece cue sticks, which often resulted in damage to the threads effected by misthreading the two shafts together.

Another object of this invention is to provide a walking cane/cue stick which has a slide movable on the forward shaft and capable of sliding forward the cue tip to effectively sharpen and steady the aim of the user.

Yet, another object of this invention is to provide a walking cane/cue stick which has a slide capable of sliding forward the cue tip to provide greater leverage for more powerful breaks of billiard racks and strokes on the cue ball by the user.

Further objects and advantages of the present invention will become apparent as the description proceeds and when taken in conjunction with the accompanying drawing wherein:

DETAILED DESCRIPTION OF THE INVENTION

Figure 1:
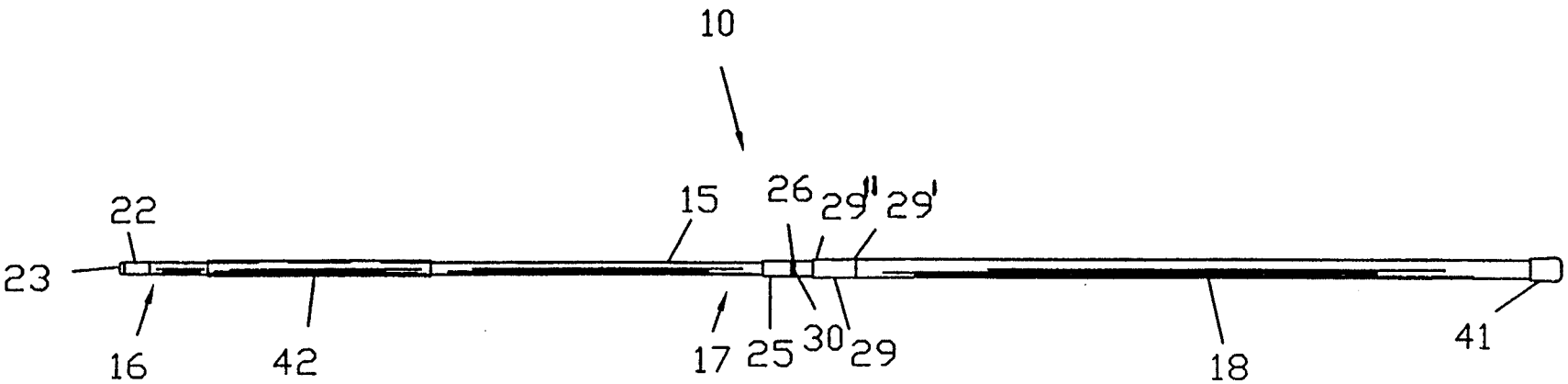
FIG. 1 is a side elevational view of the walking cane/cue stick showing the assembled cue stick with the slide mounted thereon.

Referring more particular to FIGS. 1, 2, 3, 4, and 5, the walking cane/quick attachment cue stick 10 is illustrated as having a forward generally hollow elongated cylindrical shaft 15 preferably made of metal; a cue tip 23 fixedly attached at the forward end 16 of a preferably plastic flange member 22 which is fixedly attached to the forward end of an elongated preferably wooden plug member 21 which is engagingly mounted in the forward end 16 of the forward shaft 15; a preferably metallic, fastener sleeve 25 having three substantially circumferential grooves 26, 27, and 28 therein, which are longitudinally spaced along the fastener sleeve 25 which is fixedly mounted near the rearward end 17 of the forward shaft 15; a preferably metallic, collar 29 fixedly mounted about the fastener sleeve 25 between the forward groove 26 and the middle groove 27 on the fastener sleeve 25; weighted plugs (not shown) of various ounces adaptable to engagingly slide into the rearward end 17 of the forward shaft 15 to balance and add weight to the cue stick 10 as desired by the user; three O-rings 30, 31, and 32 securely mounted in the three grooves 26, 27, and 28 in the fastener sleeve 25; a rearward substantially hollow cyclindrical shaft 18 preferably made of metal and having an open end 19 and a closed end 20 and slidably engageable with two of the O-rings to form an assembled cue stick 10 and slidably mountable on the forward shaft 15 from the forward end 16 thereof and slidably engageable with one of the O-rings for the assembled walking cane 10; a slide member 42 preferably made of a plastic elongated tube and slidably mounted on the forward shaft 15 for supporting and aiming the cue stick 10; a tubular cap member 35 preferably made of metal and having an open end 36 and a closed end 37 and slidably mountable on the fastener sleeve 25 from the rearward end 17 of the forward shaft 15 and slidably engageable with two of the O-rings 27 and 28 for the assembled walking cane 10; handhold tape (not shown) has a section of which is wrapped about the rearward shaft 18 for appearance and to assist the user to hold the cue stick 10 and a section of which is wrapped about the cap member 35 for appearance and to assist the user to hold the walking cane 10; and a pair of preferably rubber feet members 40 and 41 affixed to the closed ends of the rearward shaft 18 and cap member 35 to provide traction and support for a user using the assembled walking cane 10, in particular.

Figure 4:
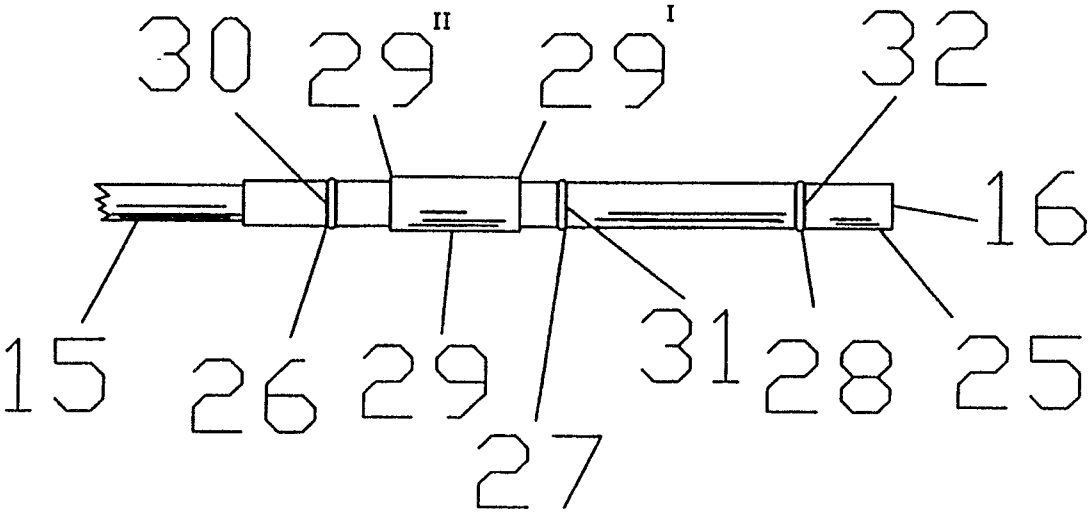
FIG. 4 is a fragmentary section view of the walking cane/cue stick showing the fastener means to assemble the cue stick.

As illustrated in FIG. 4, the fastener means comprises the fastener sleeve 25 which is fixedly mounted about the rearward end 17 of the forward shaft 15 and upon which three O-rings 30, 31, and 32 are securely mounted in the three grooves 26, 27, and 28 therein for engaging the interior of either the tubular cap member 35 or the rearward shaft 18. The fastener means further comprises the collar 29 which functions as an abutment and a stop either to the cap member 35 or to the rearward shaft 18 as either the cue stick or the walking cane are assembled. The interior diameters of either the cap member 35 or the rearward shaft 18 are approximate to the diameter of the fastener sleeve 25 with the O-rings 30, 31, and 32 radially extending outward from the surface of the fastener sleeve 25, so that as either the cap member 35 or the rearward shaft 18 slides about and over the fastener sleeve 25 and abuts the collar 29, either the rearward shaft 18 or the cap member 35 compresses the O-rings 30, 31, and 32 and slidably engages the O-rings 30, 31, and 32 to securely hold either the rearward shaft 18 or the cap member 35 about the fastener sleeve 25. The fastener means allows the user to effectively assemble and disassemble the walking cane/-cue stick 10 without having to thread one end of the rearward shaft 18 onto one end of the forward shaft 15 as with most cue sticks which are assembled by the user. This fastener means virtually eliminates potential damage to the cue stick, effected by the user incorrectly fastening or threading the two shafts to assemble the cue stick, because there are no threads to damage.

Figure 2:
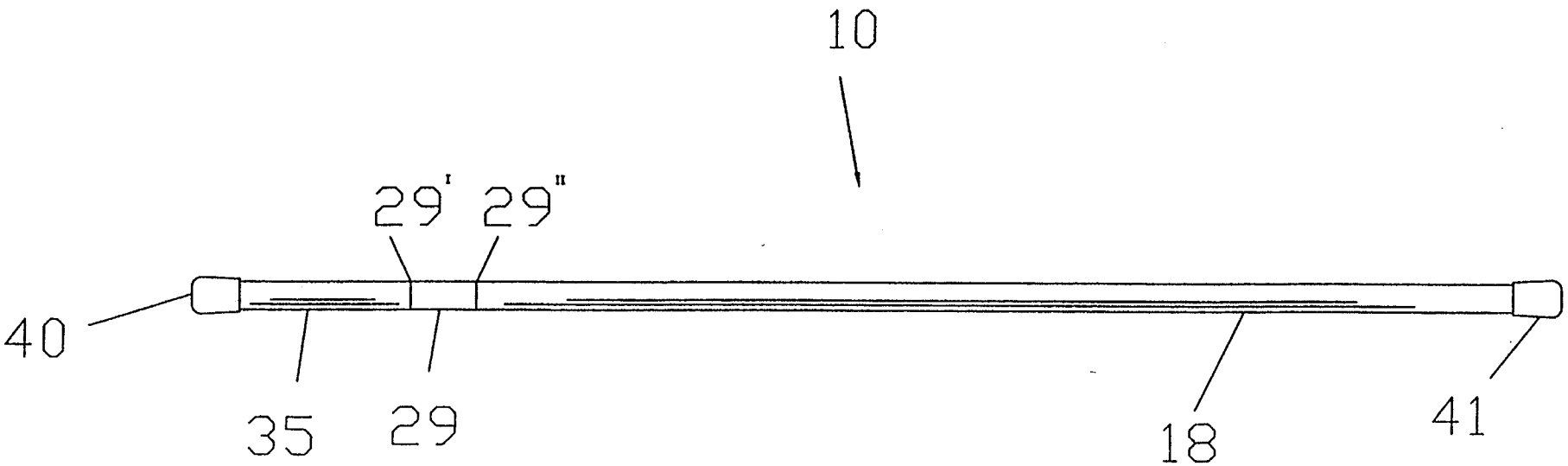
FIG. 2 is a side elevational view of the walking cane/cue stick showing the walking cane.
Figure 5:
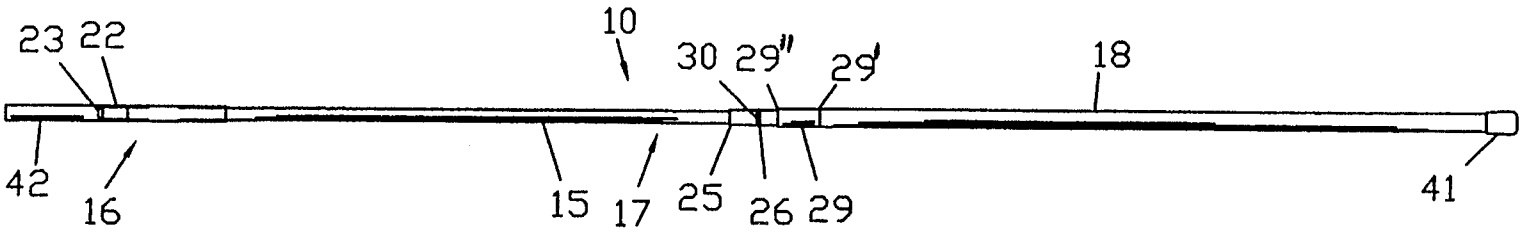
FIG. 5 is a side elevational view of the walking cane/cue stick showing the assembled cue stick with the slide extending forward the cue tip to demonstrate greater extension and leverage available to the user while not sacrificing the aim of the user.

As illustrated in FIGS. 1 , 2, and 5, the collar 29 functions as an assembled stop for either the walking cane or the cue stick and has a rear end 29' and a front end 29''. To assemble the cue stick, the user preferably slidably urges the rearward shaft 18 forward over the rearward end 17 of the forward shaft 15 about the fastener sleeve 25 into engagement with the rear end 29' of the collar 29. To disassemble the cue stick 10, the user preferably slidably urges the rearward shaft 18 away from engagement with the collar 29 and off the fastener sleeve 25. To assemble the walking cane 10, the user preferably slidably urges the rearward shaft 18 about and over the forward shaft 15 from the forward end 16 thereof and over and about the forward portion of the fastener sleeve 25 into engagement with one of the O-rings and into engagement with the front end 29'' of the collar 29, and slidably urges the tubular cap member 55 about and over the fastener sleeve 25 from the rearward end 17 of the forward shaft 15 into engagement with two of the O-rings and the rear end 29' of the collar 29.

As shown in FIG. 5, the slide member 42 is slidably mounted on the forward shaft 15 and can be slid off the forward end 16 of the forward shaft 15 and removed from the forward shaft 15. The slide member 42 provides a non-stick means to slide and guide the cue stick 10 to impact the cue ball(nob shown). The user preferably grasps the slide member 42 with his/her fingers on the extended arm and reciprocally urges the cue stick 10 with the other arm to impact the cue ball. The slide member 42 can be slid rearward on the forward shaft 15 to engage the fastener sleeve 25 and can be slid forward beyond the cue tip 25 for leverage and extension to generate power without sacrificing aim of the user to impact the cue ball. The user positions the slide member 42 preferably adjacent the cue ball, essentially steadying the aim of the user, and the user withdraws the cue stick 10 rearward relative to the slide member 42 moving the cue tip 23 rearwardly within the slide member 42 to provide leverage to effectively impact the cue ball. The slide member 42 steadies the aim of the user, because as the cue stick 10 is withdrawn from adjacent the cue ball through the slide member 42, the slide member 42 remains stationary adjacent the cue ball and provides a conduit through which the cue stick 10 traverses upon impacting the cue ball.

Figure 3:
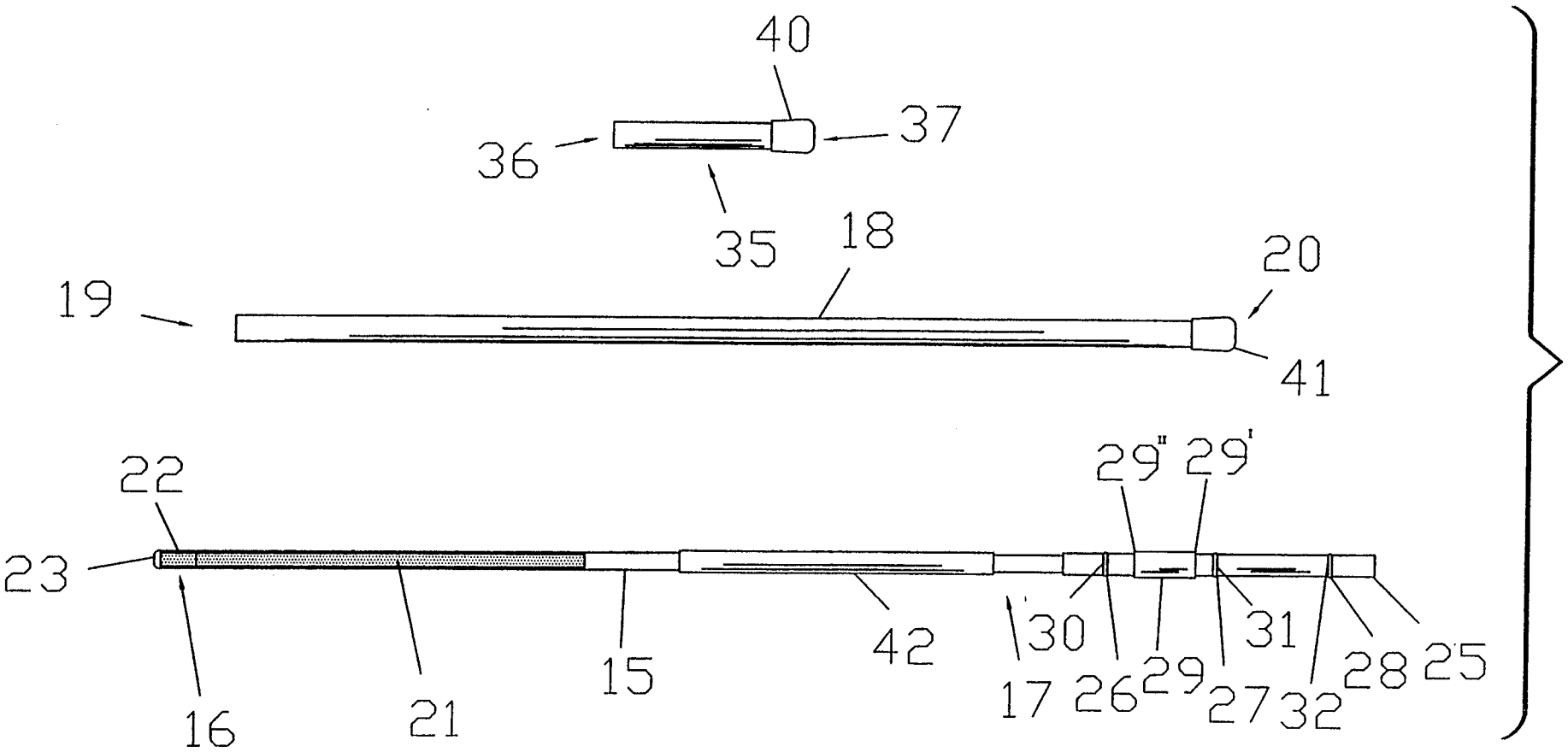
FIG. 3 is a side elevational view of the walking cane/cue stick showing the unassembled cue stick with the parts thereof including the hidden view of the elongated plug member engageably mounted in the forward shaft.

As illustrated in FIGS. 1 and 3, the elongated plug member 21 engageably mounted into the forward end 16 of the forward shaft 15 with the flange member 22 fixedly attached to an end thereof effectively absorbs the shock vibrations effected by the user impacting the cue ball with the cue stick 10.

It will be obvious that various changes and departures may be made to the invention without departing from the spirit and scope thereof. Accordingly, it is not intended that the invention be limited to that specifically described in the specification or as illustrated in the drawing but only as set forth in the claims.

What is claimed is:

1. A combination walking cane and quick attachment cue stick comprising:

a hollow elongated forward shaft having a forward end and a rearward end;

an elongated plug member engagingly mounted in said forward end of said forward shaft and having a tip at a forward end of said forward shaft for impacting a cue ball;

a generally hollow elongated rearward shaft having a closed end and an open end and slidably engageable on said rear end of said forward shaft for assembling a cue stick and slidably engageable on said forward end of said forward shaft for assembling a walking cane;

a tubular cap member slidably engageable on said rear end of said forward shaft opposite of said rearward shaft for assembling a single walking cane;

an engageable fastener means fixedly mounted near said rearward end of said forward shaft, said fastener means having a fastener sleeve fixedly mounted about said rearward end of said forward shaft and having a plurality of circumferential grooves spaced thereabout, having a collar fixedly mounted about a portion of said fastener sleeve between said grooves to provide an abutment and a stop for either said cap member or said rearward shaft, and having a plurality of resilient rings in said grooves for compressibly engaging interior diameters of either said cap member or said rearward shaft for assembling said cue stick or said walking cane;

a pair of feet members, one fixedly attached to said closed end of said rearward shaft and the other fixedly attached to an end of said cap member; and a slide member mounted on said forward shaft and slidably extendable forward said tip of said cue stick to guide said cue stick and assist the aim of a user.

2. A combination walking cane and quick attachment cue stick as described in claim 1, wherein said fastener sleeve further has a diameter approximate to said interior diameters of said cap member or said rearward shaft to abut and stop rearward movement of said slid member.

3. A combination walking cane and quick attachment cue stick as described in claim 1, wherein said plurality of resilient rings extend outward from a surface of said fastener sleeve for engaging said interior diameter of said cap member or said rearward shaft.

4. A combination walking cane and quick attachment cue stick as described in claim 1, wherein said collar has an exterior diameter substantially approximate to exterior diameters of said cap member or said rearward shaft to provide a surface substantially flush with surfaces of said cap member or said rearward shaft.

* * * * *